US007905279B2

(12) United States Patent
Hart et al.

(10) Patent No.: US 7,905,279 B2
(45) Date of Patent: Mar. 15, 2011

(54) COMBINATION WHIPSTOCK AND SEAL BORE DIVERTER SYSTEM

(75) Inventors: Daniel R. Hart, Sugar Land, TX (US); Roy E. Swanson, Sugar Land, TX (US); Kjell Nygardsvoll, Stavanger (NO); Songfeng Yang, Cypress, TX (US); Christopher W. Guidry, Spring, TX (US); Charles W. Pleasants, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/103,023

(22) Filed: Apr. 15, 2008

(65) Prior Publication Data

US 2009/0255664 A1 Oct. 15, 2009

(51) Int. Cl.
*E21B 7/04* (2006.01)

(52) U.S. Cl. ..... 166/177.6

(58) Field of Classification Search ..... 175/61; 166/117.5, 117.6

See application file for complete search history.

(56) References Cited

U.S. PATENT DOCUMENTS

| | | | | |
|---|---|---|---|---|
| 5,474,126 | A * | 12/1995 | Lynde et al. | 166/117.6 |
| 5,566,762 | A * | 10/1996 | Braddick et al. | 166/382 |
| 6,050,334 | A * | 4/2000 | McGarian et al. | 166/117.6 |
| 6,076,606 | A * | 6/2000 | Bailey et al. | 166/382 |
| 6,910,538 | B2 * | 6/2005 | Tinker | 166/380 |
| 6,968,903 | B2 * | 11/2005 | Pollard | 166/382 |

OTHER PUBLICATIONS

Leo A. Giangiacorno, Rocky Mountain Olifield Testing Center, A Review of New Multilateral Technology at the Rocky Mountain Oilfield Testing Center, Presentation at Petroleum Network Education Conference's 9th International Conference on Horizontal Well Technology and Applications; Aug. 25-27, 1997; pp. 1-7.

Dennis Denney, "Constructing an Offshore Reformable Corrosion-Resistant-Alloy Multilateral Junction contains highlights of paper SPE96343," JPT; Jul. 2006, pp. 73-75.

* cited by examiner

*Primary Examiner* — David J Bagnell
*Assistant Examiner* — James G Sayre
(74) *Attorney, Agent, or Firm* — Cantor Colburn LLP

(57) ABSTRACT

A combination whipstock and seal bore diverter system includes a whipstock; and a diverter configured to receive and support the whipstock in a selected orientation, the system being installable in a single run in a borehole.

23 Claims, 7 Drawing Sheets

COMBINATION WHIPSTOCK AND SEAL BORE DIVERTER SYSTEM

BACKGROUND

Whipstock and seal bore diverters are well known pieces of equipment in the hydrocarbon recovery industry. Each has its purpose and requires that it be run in the hole to be used. Heretofore, these tools were run in the hole separately as they are separate tools and do not have complementary shapes to one another. Whipstocks are used to divert a milling bit through a wall of the primary borehole through which the mill is run from a location uphole. This is, of course, the beginning of a lateral borehole. The whipstock may or may not include hardened surfaces at the diverter portion thereof to resist the milling bit. A seal bore diverter is used to divert a junction or junction liner into the already drilled lateral borehole. The diverter face angle may be different to ensure that a later run junction or junction liner is directed through a large portion of the window exit. The seal bore diverter may or may not have hardened surfaces on the diverter face. Because of the distinctness of the tools, they are both required and are run separately. In view of the desirability of greater efficiency and the consequent improved monetary return, the art would well receive a system that reduces the number of runs necessary and the length of time the lateral borehole remains exposed to possible collapse or contamination from borehole fluid.

SUMMARY

A combination whipstock and seal bore diverter system includes a whipstock; and a diverter configured to receive and support the whipstock in a selected orientation, the system being installable in a single run in a borehole.

BRIEF DESCRIPTION OF THE DRAWINGS

Referring now to the drawings wherein like elements are numbered alike in the several Figures.

DETAILED DESCRIPTION

Figure 1:
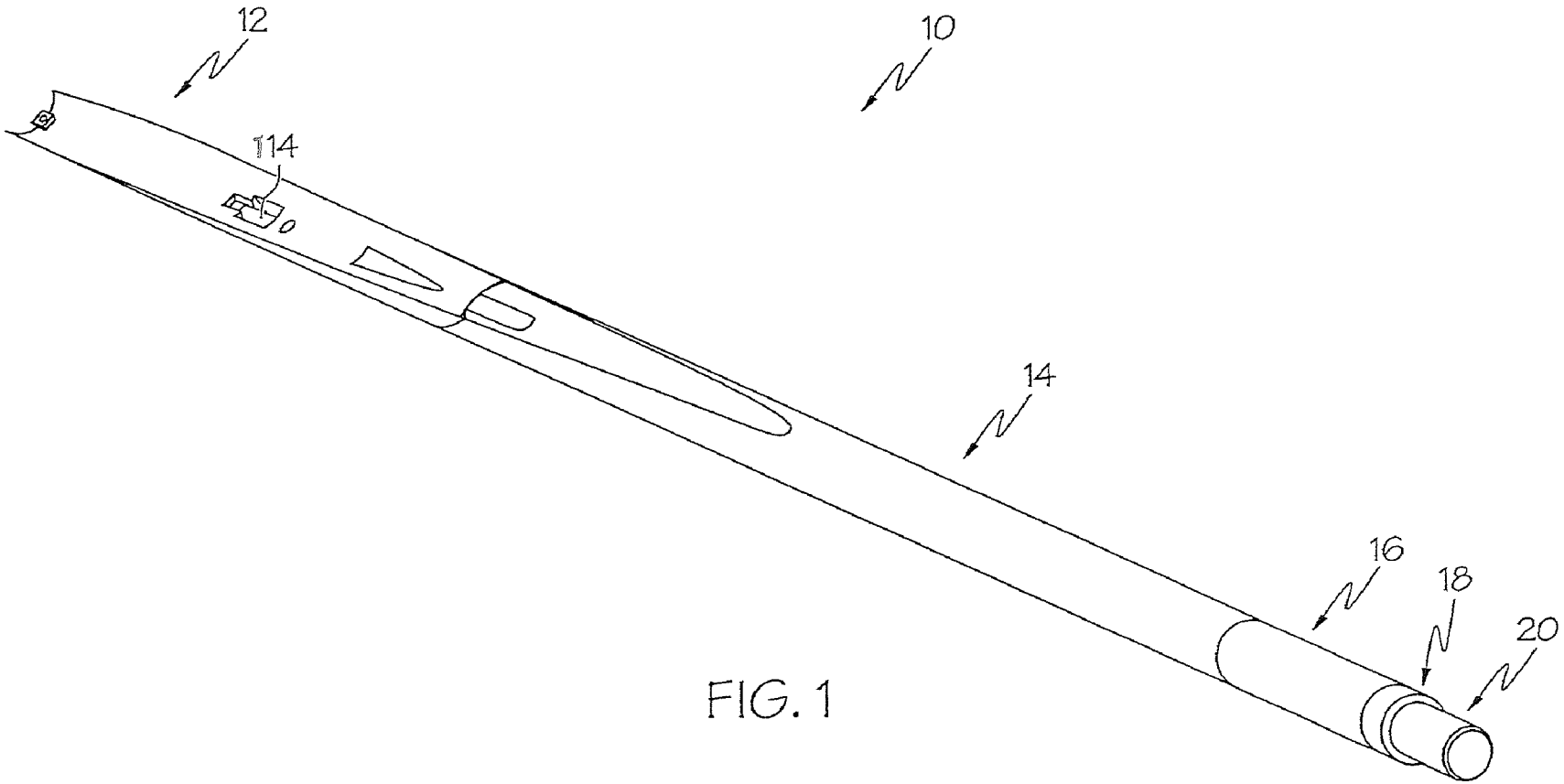
FIG. 1 is a perspective view of one embodiment of a combination whipstock and seal bore diverter system as disclosed herein.

Referring to FIG. 1, a combination whipstock and seal bore diverter system 10 is illustrated. The system 10 includes a whipstock 12, a diverter 14, a joint 16, a connection ring 18, and a connector 20. These components are operably connected to one another to form the combination whipstock and seal bore diverter system 10 disclosed herein. One of the features of the system 10 is that the whipstock 12 is separable from the diverter 14. This allows the whipstock 12 to be retrieved to surface and leaves the diverter 14 installed and oriented to receive a later installed junction. The junction will then complete the section of a wellbore (not shown) in which the system 10 is initially installed. While separability has been mentioned above, reintroduction of a whipstock 12 to the diverter 14 is also possible with the system 10. In order to promote the separability and reintroduction, the whipstock 12 comprises several components that allow separation from and re-engagement with the diverter 14 under selected conditions.

Figure 2:
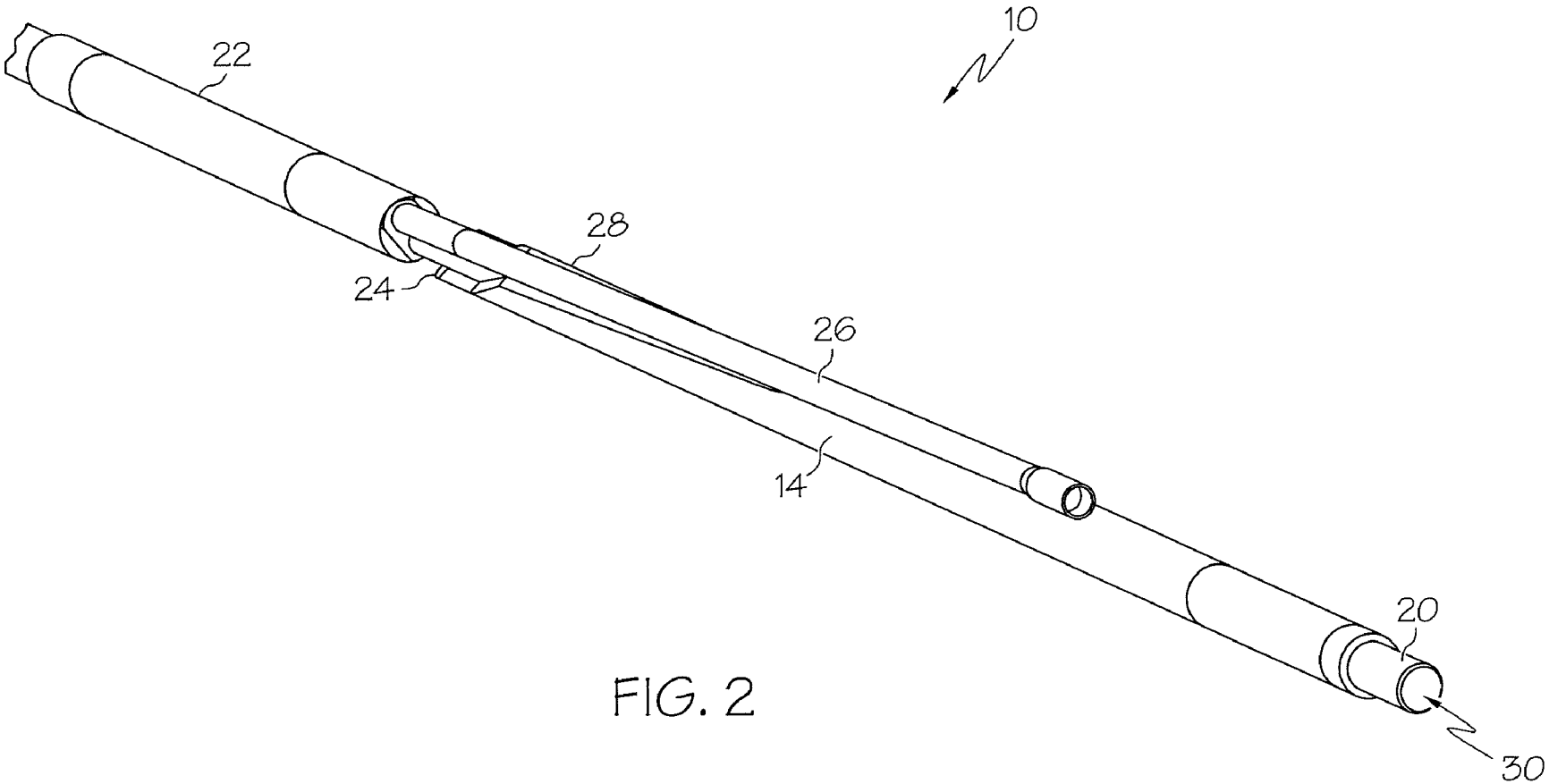
FIG. 2 is a perspective view of the system illustrated in FIG. 1 after the milling bit has created a window exit, the whipstock has been recovered, and a junction or junction liner is installed.

Referring to FIG. 2, the system 10 is illustrated post separation of the whipstock 12 and post installation of a separately run junction 22, such as a Hydrasplit™ junction, commercially available from Baker Oil Tools, Houston, Tex. under Material Number H289220000. The junction 22 comprises a primary leg 24 and a lateral leg 26. As illustrated in FIG. 2, the lateral leg 26 is diverted from the primary bore by diverter face 28 of diverter 14, while the primary leg 24 is received within a bore of diverter 14, illustrated and described later in this document, and is fluidly connected with an inside diameter flow pathway 30 extending through the system 10 (in sections, demarcated in FIGS. 3 and 5 as 30*a*-30*g*) and defined in part by connector 20. Connector 20 is configured to be received in an anchor 51 (see FIG. 5) that has been previously installed and oriented or that is run in conjunction with system 10, but in any event, that is conventional. The lateral leg 26, having been diverted by the diverter face 28, will extend into a lateral borehole (not shown) that has been drilled using the whipstock 12 before retrieval thereof to the surface. It is to be appreciated that the positioning and angle of the diverter face 28 is set such that the lateral leg 26 exits the primary borehole (not shown) at a widest point of a window (not shown) that has been milled in a casing (not shown) of the primary borehole. This improves the likelihood that the lateral leg 26 will indeed find its mark without becoming impacted by an edge of the window.

Returning to FIG. 1, it is to be appreciated that the system 10, built at a surface location, may be run into the primary borehole, subsequent to the installation of an anchor or in conjunction with the anchor, to a particular selected depth and orientation in the borehole where it is desired to create a lateral borehole. This, of course, is related to accessing a formation area determined to contain a target hydrocarbon fluid. Whether the anchor is run and installed before the system 10 or in conjunction with the system 10, the anchor is set in the borehole at the desired depth and with a particular orientation in a conventional way. The system 10 is oriented to the anchor orientation.

Figure 3:
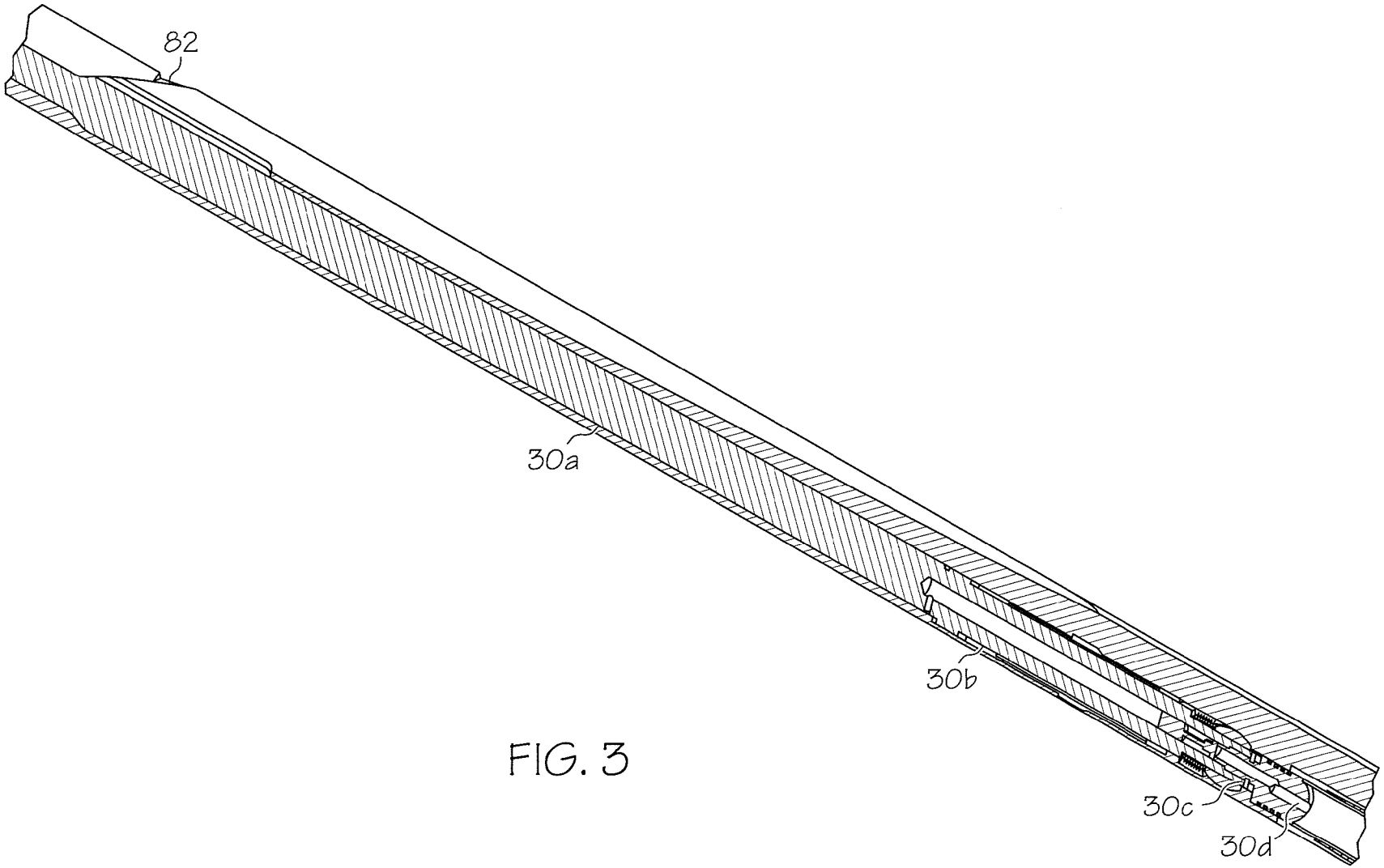
FIGS. 3-5 are an elongated sectional view of the system illustrated in FIG. 1.
Figure 4:
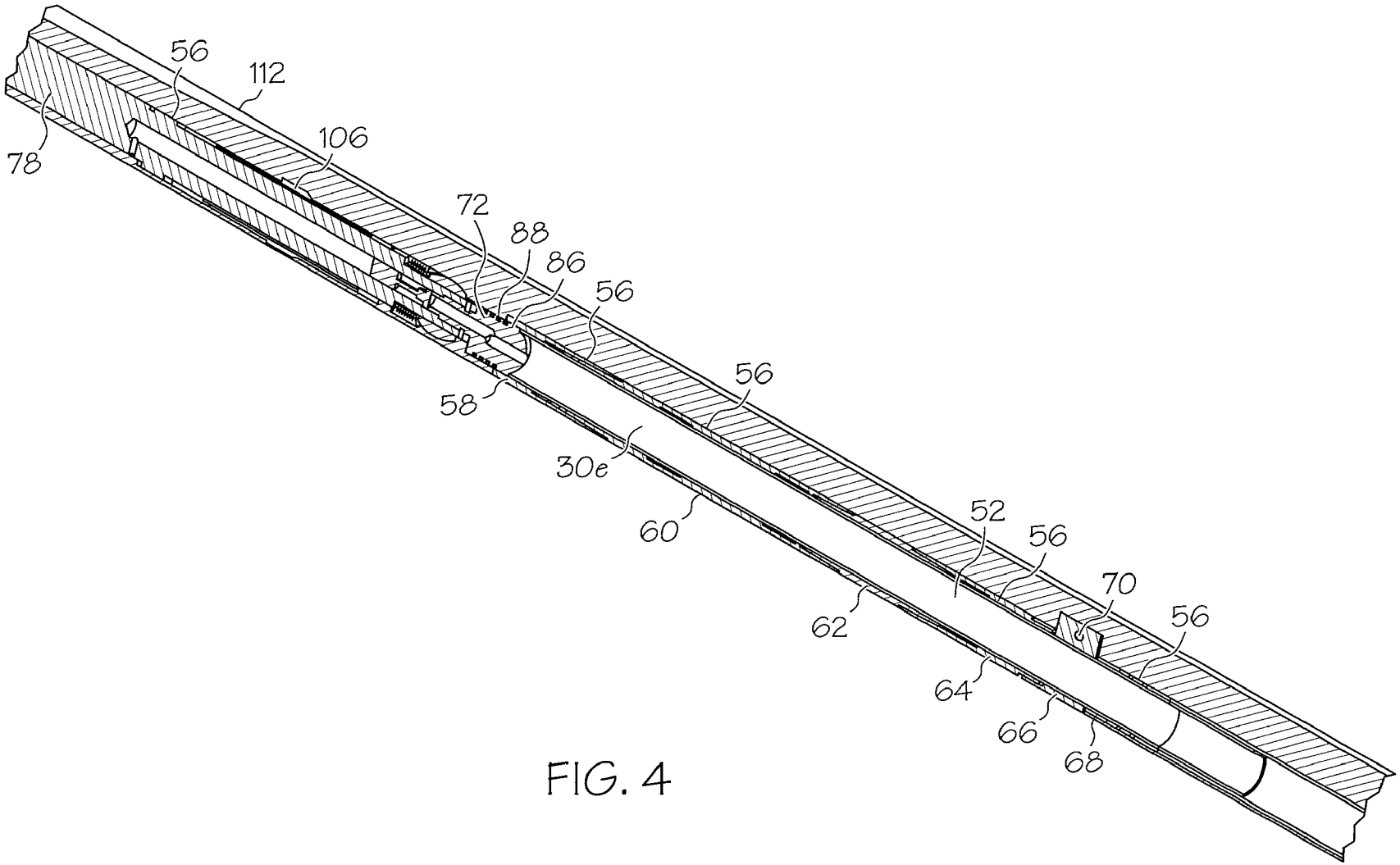
Figure 5:
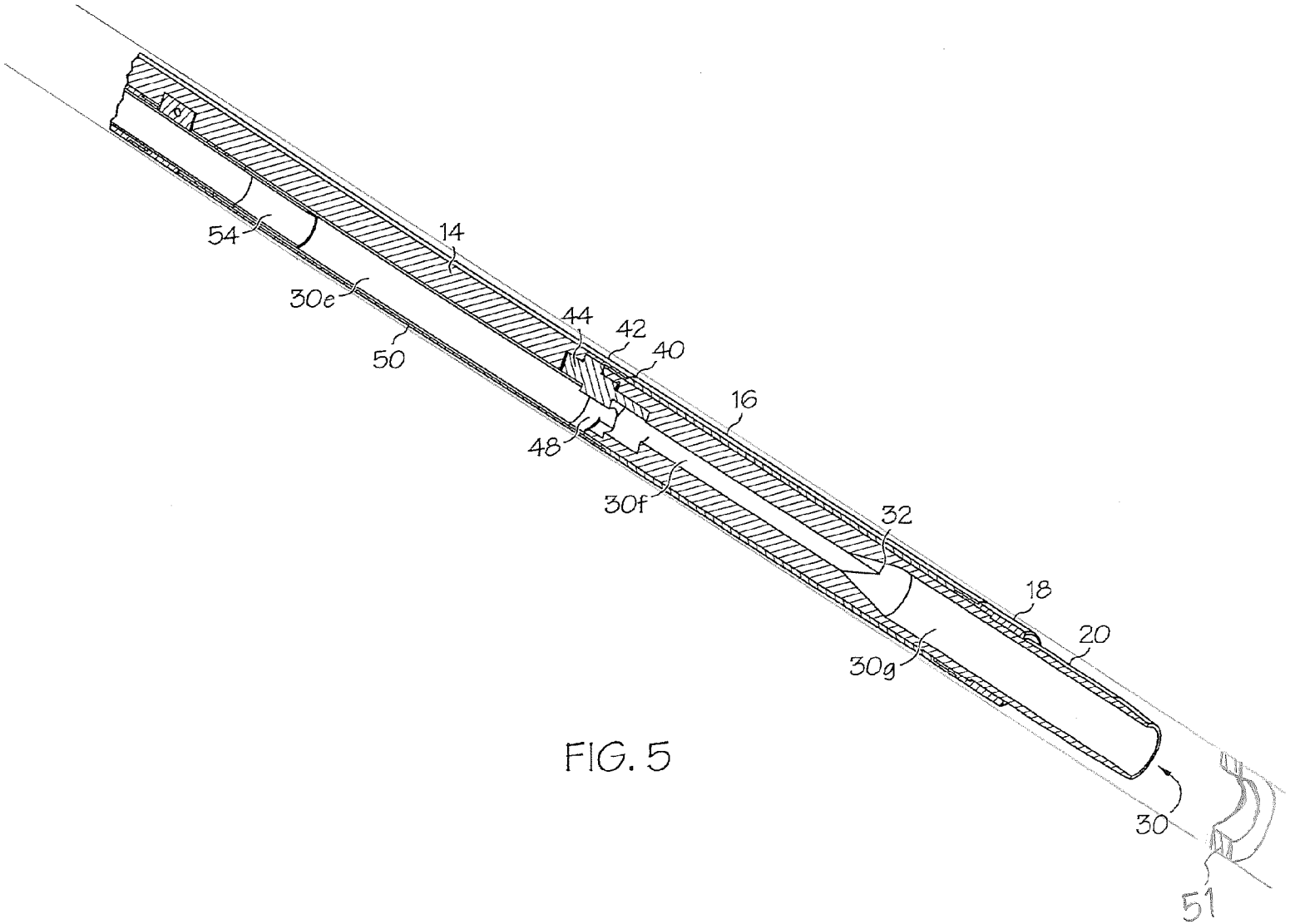

Referring to FIGS. 3, 4, and 5, an elongated sectional view of the diverter 14 provides an understanding of how the components of system 10 function together. Beginning with FIG. 5, the downhole most portion (in one embodiment; it is to be understood that the device could also be built upside down) of the diverter 14 is illustrated in an enlarged view. It will be appreciated from this view that connector 20 extends through connection ring 18 and joint 16 and defines the pathway 30, as stated above. It should also be noticed in this view that the pathway 30*g*, which is centralized at the downhole end of the connector 20, includes a jog 32 to an intermediate pathway 30*f*. The intermediate pathway 30*f* is offset relative to the axis of the connector 20, but the fluid communication between pathway 30*g* and pathway 30*e* is still enabled. Pathway 30*e* being offset is to accommodate the positioning of pathway 30*a* through 30*e*. Pathway sections 30*a* through 30*e* are positioned generally parallel to the axis of the system 10 but offset therefrom to allow for the diverter face 28 (see FIG. 2) and a whipstock face 36 (See FIG. 6). Because the faces 28 and 36 remove material from the whipstock 12 and diverter 14 in sufficient quantity to have otherwise breached the pathway 30, the offset is necessary for functionality of the system 10. The pathway 30, in one embodiment, is thus offset from the axis of the system 10 as much as is practicable, leaving about ¼ inch of material of the diverter at the portion of that component opposite the diverter face 28 to define the pathway 30. Reference to FIGS. 3-5 makes the pathway 30 clear, with numerals identifying each portion thereof on the various figures.

Referring back to FIG. 5, the system 10 includes a connection point 40 between the joint 16 and the diverter 14. The components are in this embodiment, threadedly connected at thread 42 but further include a spline sub 44. The spline sub 44 features a single position spline configuration. The joint 16 and the diverter 14 fit together in only one way. This configuration is beneficial in that the offshore baskets used to transport materials restrict the length of components that will fit. The spline sub facilitates reassembly on a rig floor while ensuring that the orientation of the whipstock 12 and diverter 14 relative to components below the diverter (such as a shear disconnect sub, polished bore receptacle seal assembly, and packer anchor, all not shown) is maintained. The spline sub 44 must also provide a fluid passageway 48 to connect the pathway 30*e* to the pathway 30*f*.

Continuing to move in the uphole direction, in this embodiment, and now referring to FIGS. 4 and 5, a cover sleeve 50 is illustrated disposed within the diverter 14. The cover sleeve 50 telescopically receives a seal protector sleeve 52 subsequent to release of a release member 54, which may be a shear ring (as illustrated) in some embodiments, and in one specific embodiment requires a compressive load of about 20,000 pounds to release. Action of the release member 54 is to maintain the seal protector sleeve 52 in the proper position (illustrated) until the junction 22 (see FIG. 2) is installed, at which point the primary leg 24 of the junction 22 lands on the seal protector sleeve 52, loading the same axially until the release member 54 releases (e.g. shears) and allows the seal protector sleeve 52 to move telescopically into the cover sleeve 50 thereby exposing a plurality of seal stacks 56 to sealingly engage with the primary leg 24 (see FIG. 2). In one embodiment, the seals are all maintained in position by a top sub 58, a seal sub 60, a bottom seal sub 62, a bottom sub 64, a seal holder 66, and a seal keeper ring 68. It should be understood that the exact configuration of components to maintain the seal stacks 56 in position may be modified without departing from the scope of the invention. All that is required is that a seal system be provided to fluid sealingly engage the primary leg 24 of the junction 22 (see FIG. 2) at the appropriate time. It is desirable that the seals be protected from debris or physical damage prior to landing of the primary leg 24 by a suitable protector, the seal protector sleeve 52 being one possible option. Such may be accomplished in many configurations. The seal holder 66 in this embodiment is a squared off structure to easily slip into the diverter 14 but to securely hold the seal structure 58-64 in place within diverter 14. In one embodiment, the seal holder 66 is itself pinned to the diverter 14 at pin 70, which may be a threaded fastener, for example. Top sub 58, apart from providing structure for associated seal stacks 56, also provides a seal bore 72 for sealing receipt of a portion of the whipstock 12.

Figure 6:
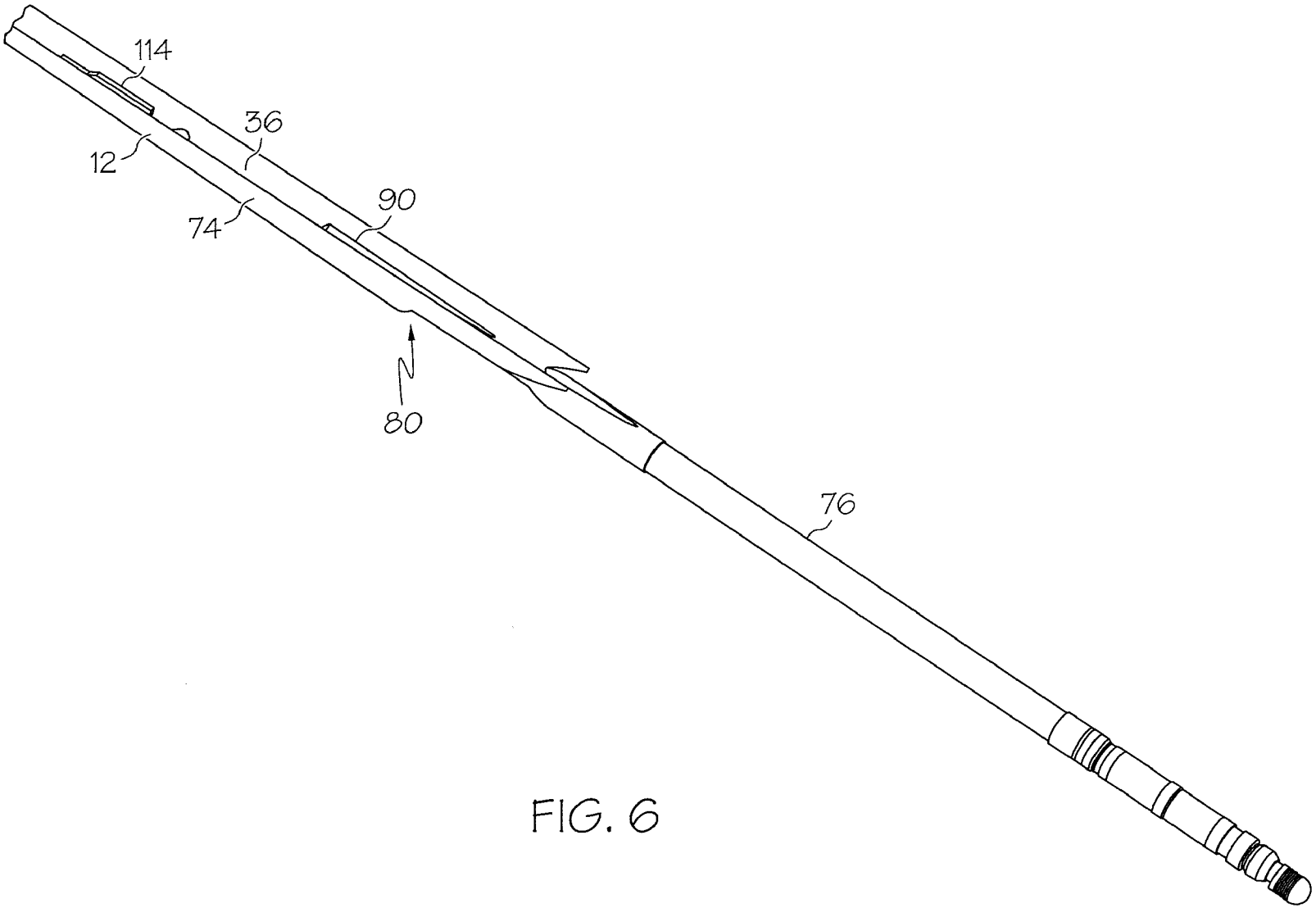
FIG. 6 is a perspective view of the retrievable whipstock portion of the system illustrated in FIG. 1.
Figure 7:
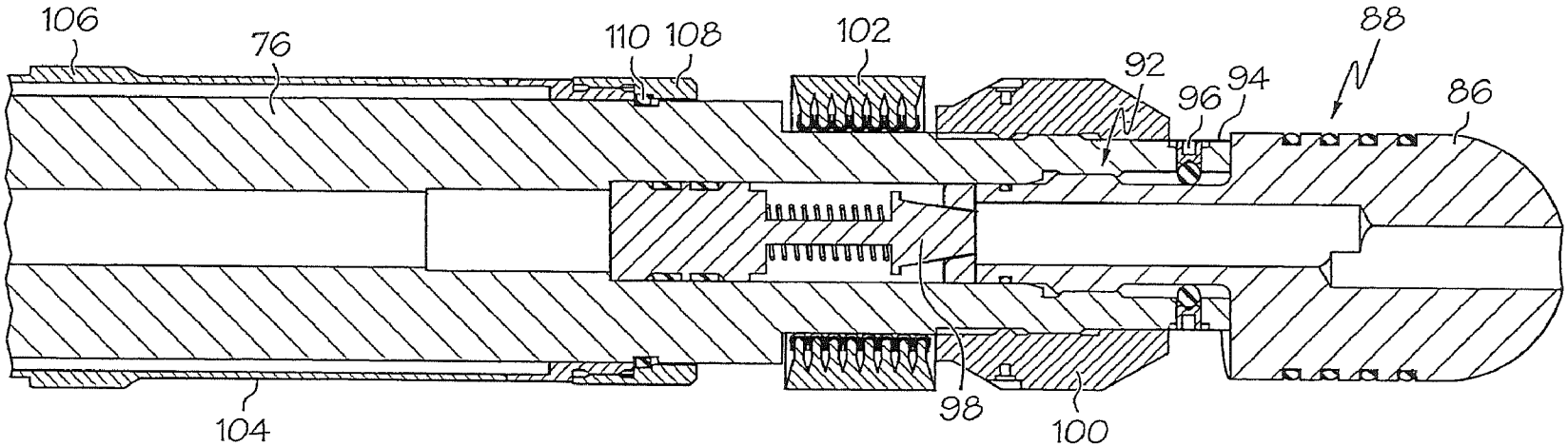
FIG. 7 is an enlarged sectional view of a portion of an interengagement body of FIG. 6.

Referring to FIGS. 4, 6, and 7, the whipstock 12 comprises two major components in the illustrated embodiment. These are a scoop body 74 and an interconnection body 76. These components are received in operable communication with the diverter 14 by insertion of the interconnection body 76 into a receiving bore 78 of diverter 14 and a base 80 of the scoop body 74 coming into contact with an end 82 of the diverter 14 (see FIG. 3). A spool sub 86, extending from interconnection body 76 (which also houses pathways 30*c* and 30*d*), supports one or more seals 88, such as o-rings, to sealingly engage seal bore 72.

The scoop body 74 and the interconnection body 76 are connected to one another by a fastening process, such as by welding, or by mechanical configuration. It is to be noted that in the illustrated embodiment, the interconnection body 76 also is scalloped at surface 90 to match surface 36 for a smooth transition of a mill (not shown) being diverted by the scoop body 74 when the system 10 is in use.

Referring to FIG. 7, the spool sub 86 is received within one end of the interconnection body 76. In the illustrated embodiment, the spool sub 86 is threadedly connected to the interconnection body 76 as illustrated by thread 92. It will be appreciated that other configurations resulting in the connection are substitutable. When the connection is a threaded one, as shown, an arrangement to prevent unthreading is desirable. One embodiment of such an arrangement is shown as at least one ball, and here two balls 94, held in place by set screws 96. The spool sub 86 provides for a flow of fluid therethrough while inhibiting flow therearound with seals 88 in contact with the seal bore 72. It is important that fluid be able to flow through the spool sub 86 in order to prevent floating of the system 10. Equally as important, however, is that fluid only flows in one direction, so that debris from the milling operation to take place upon the whipstock face 36 cannot migrate through the spool sub 86. Dispatching this duty is a float valve assembly 98 (a check valve arrangement), which is commercially available from Baker Oil Tools, Houston, Tex. under Part Number H480131200. Fluid flowing through the assembly 98, is exhausted to pathway 30*a* (an annular space defined at the receiving bore 78) just beyond a seal stack 56 through pathway 30*b*. Further, the interconnection body 76 includes a guide 100 that assists in controlled axial movement of the interconnection body 76 and a debris exclusion configuration 102, such as a wire brush to prevent debris migration from the whipstock face 36 into the seal area of the diverter 14.

For retrievability of the whipstock 12, a collet 104 having a profile 106 thereon is disposed about the interconnection body 76 and maintained in position there by a pair of cover rings 108 and a retaining ring 110, other similarly functioning arrangements being substitutable without departing from the scope of the invention. The collet profile 106 is complementary to a profile receptacle 112 at the bore 78 (see FIG. 4). The collet 104 is configured to release at a predetermined pull load and thus allows retrieval of the whipstock 12 and all of its components. The retrieval is effected by a pull load on a locking retrieval slot 114 (see FIG. 1).

In use, the combination whipstock and seal bore diverter system 10 is affixed to a milling assembly (not shown) or run in the hole on its own. The system 10 is oriented and a mill is brought into contact with whipstock face 36 to divert the mill through a casing wall and thereby create a window. While creating the window, a substantial amount of debris will be created, but that debris is prevented from migrating into the diverter 14 by debris excluder 102, valve 98 (see FIG. 7), and seal stacks 56 (see FIG. 4). After the window is milled, the whipstock 12 is retrieved to surface by latching thereto through the slot 114 and pulling thereon in an amount exceeding the release amount required to release the release mechanism, which in the illustrated embodiment is collet 104. Once the collet 104 releases from profile receptacle 112, the whipstock 12 will begin to move uphole. In a separate run, a junction, such as junction 22, is run in the hole so that primary leg 24 stabs into the diverter 14 and engages seal stacks 56 subsequent to landing upon the seal protector sleeve 52 and shearing the release member 54 allowing the seal protector sleeve 52 to move into the cover sleeve 50. The primary leg 24 then is sealed to the diverter 14. While the sealing is occurring, the lateral leg 26 of the junction 22 is being diverted out of the window (not shown) by the diverter face 28. Once the junction 22 is fully seated in the diverter 14, the operation is complete.

The configuration disclosed herein provides many benefits to the hydrocarbon recovery industry, such as but not limited to: reduction of the number of trips in the hole necessary to successfully create a lateral borehole and complete a junction, thereby reducing costs and rig time; reduction of the time that a newly drilled junction is open, thereby greatly enhancing the likelihood that the junction will remain open long enough to complete the operation; ability to position the seal bore diverter (herein denoted as diverter 14) prior to window formation to ensure proper orientation and to avoid problems associated with debris in the hole when diverter is traditionally subsequently located; ability to retrieve the whipstock 12 and replace it with a new one, if conditions require, without having any concern about consistent orientation; release member 54 in diverter 14 provides a positive indicator that the junction 22 is landed; and the spline sub 44 allows for the system to be disassembled for shipping without concern regarding proper realignment when re-assembled on a rig floor.

While preferred embodiments have been shown and described, modifications and substitutions may be made thereto without departing from the spirit and scope of the invention. Accordingly, it is to be understood that the present invention has been described by way of illustrations and not limitations.

The invention claimed is:

1. A combination whipstock and seal bore diverter system comprising:

a whipstock; and a diverter configured to receive and support the whipstock in a selected orientation, the system being installable in a single run in a borehole, the diverter including a seal assembly having a seal protector sleeve disposed thereat prior to actuation of the system.

2. The system as claimed in claim 1 wherein the whipstock comprises a scoop body and an interconnection body.

3. The system as claimed in claim 2 wherein the scoop body includes a retrieval slot.

4. The system as claimed in claim 2 wherein the interconnection body includes a spool sub configured to sealingly engage the diverter.

5. The system as claimed in claim 2 wherein the interconnection body includes a check valve.

6. The system as claimed in claim 5 wherein the check valve is a float valve assembly.

7. The system as claimed in claim 2 wherein the interconnection body includes a debris excluder.

8. The system as claimed in claim 1 wherein the seal protector sleeve is telescopically receivable in a cover sleeve upon actuation of the system.

9. The system as claimed in claim 1 wherein the seal protector sleeve is operably coupled with a release member.

10. The system as claimed in claim 9 wherein the release member is responsive to an axial compression load.

11. The system as claimed in claim 2 wherein the system includes a collet disposed to engage the diverter with the whipstock in a releasable affixation.

12. The system as claimed in claim 11 wherein the collet is mounted on the whipstock and interengages with a profile recess in the diverter.

13. The system as claimed in claim 11 wherein the collet releases at about 40,000 lbs pull load.

14. The system as claimed in claim 1 wherein the whipstock and diverter are separable and re-engageable.

15. The system as claimed in claim 14 wherein orientation of the whipstock and diverter is maintained upon re-engagement after separation.

16. A combination whipstock and seal bore diverter system comprising:

a whipstock; and a diverter configured to receive and support the whipstock in a selected orientation, the system being installable in a single run in a borehole, the system defining a flow pathway that is offset from an axis of the system thereby allowing the flow pathway to be unencumbered by a face surface of the whipstock.

17. The system as claimed in claim 1 wherein the system is prealignable with an anchor to ensure selected orientation downhole.

18. The system as claimed in claim 16 wherein the whipstock is separable from the diverter leaving the diverter installed.

19. The system as claimed in claim 18 wherein the diverter remains oriented to receive a later installed junction.

20. The system as claimed in claim 16 wherein the diverter is configured to receive the same or another whipstock after separation of the whipstock from the diverter.

21. The system as claimed in claim 20 wherein the diverter ensures consistent orientation of the same or another whipstock received after separation of the whipstock.

22. A combination whipstock and seal bore diverter system comprising:

a whipstock having a scoop body and an interconnection body, the interconnection body including a spool sub configured to sealingly engage the diverter; and a diverter configured to receive and support the whipstock in a selected orientation, the system being installable in a single run in a borehole.

23. The system as claimed in claim 22 wherein the scoop body includes a retrieval slot.

* * * * *